US005466191A

United States Patent [19]

Chang

[11] Patent Number: 5,466,191

[45] Date of Patent: Nov. 14, 1995

[54] IMPULSE DRIVEN ROCKING APPARATUS INSTALLED WITH ELLIPTICALLY-SHAPED SPRINGS

[76] Inventor: Fountain Chang, No. 30, Hsi-Ning S. Rd., Taipei, Taiwan

[21] Appl. No.: 227,400

[22] Filed: Apr. 14, 1994

[51] Int. Cl.[6] ..... A63G 17/00

[52] U.S. Cl. ..... 472/95; 472/100; 472/102; 472/103; 280/1.175

[58] Field of Search ..... 472/95, 99, 100, 472/101, 102, 103, 104, 105, 135; 446/325; 280/1.13, 1.165, 1.175, 1.181, 1.182, 1.183, 1.184, 1.189, 1.191, 1.193, 1.208

[56] References Cited

U.S. PATENT DOCUMENTS

| | | | |
|---|---|---|---|
| 2,913,248 | 11/1959 | Bauer | 280/1.183 |
| 4,494,763 | 1/1985 | Whitehead . | |
| 4,834,402 | 5/1989 | Jian . | |
| 4,989,856 | 2/1991 | Shieh . | |
| 5,180,338 | 1/1993 | Pinto . | |
| 5,238,455 | 8/1993 | Cain, Jr. . | |

FOREIGN PATENT DOCUMENTS

| | | | |
|---|---|---|---|
| 594732 | 9/1925 | France | 280/1.175 |

*Primary Examiner*—Carl D. Friedman
*Assistant Examiner*—Kien T. Nguyen
*Attorney, Agent, or Firm*—Ladas & Parry

[57] ABSTRACT

A rocking apparatus comprises a rocking base and a user support body mounted on the rocking base. The rocking base has a front end with a front strut fixed thereto. The front strut inclines upwardly by a predetermined angle and has a first wheel unit provided thereon. The rocking base further has two curved rocking plates and a second wheel unit mounted on front ends of the rocking plates. Hard forward rocking movement of the rocking apparatus results in the first and second wheel units contacting a support surface at the same time and the rocking plates separating from the support surface to permit forward movement of the rocking apparatus. At least one spring unit is interposed between the user support body and the rocking base to permit vertical reciprocating movement of the user support body. The first wheel unit includes a wheel support mounted rotatably on a distal end section of the front strut and provided with a steering axle that extends therethrough. The wheel support carries a wheel thereat. A pair of reins are disposed on two sides of the user support body. Each of the reins has one end tied to the steering axle. The reins are pulled to cause slight turning of the wheel support in order to steer the rocking apparatus.

15 Claims, 7 Drawing Sheets

IMPULSE DRIVEN ROCKING APPARATUS INSTALLED WITH ELLIPTICALLY-SHAPED SPRINGS

BACKGROUND OF THE INVENTION

1. Field of the Invention

The invention relates to a rocking apparatus, more particularly to a rocking apparatus that is capable of moving forward and bouncing up-and-down simultaneous with the control of direction.

2. Description of the Related Art

A conventional rocking apparatus, such as a wooden rocking horse, comprises a user support body mounted on a pair of rocker arms. Rocking movement of the apparatus results whenever a child seated on the user support body shifts his body weight. Because the movement of this apparatus is limited only to rocking movement, an older child playing with this apparatus will become bored easily.

U.S. Pat. No. 5,238,455 discloses a rocking apparatus which permits rocking movement in any direction. The rocking apparatus includes a seating assembly and a base assembly which comprises two diagonally disposed rocking members crossed at a median point of the rocking apparatus. The movement of this apparatus is also limited only to rocking movement.

U.S. Pat. No. 5,180,338 discloses a riding toy mechanism which incorporates coil springs to generate presumably vertical reciprocating movement of the user support body. Due to the unpredictable reaction of the coil springs when the child shifts his weight, a feeling of instability arises and the child is easily overwhelmed with fear and insecurity. Note that the child has to exert a greater amount of force to control the movement of the user support body because the direction of the coil springs cannot be controlled easily, thereby easily tiring the child. In addition, the coil springs are unable to provide the user support body with a forward lunging movement.

U.S. Pat. No. 4,494,763 discloses a wheeled rocker toy which comprises a rider supporting body supported on a pair of spaced, opposed rockers. The rider supporting body has forward and rearward wheels mounted rotatably thereon. The forward wheel contacts the floor upon forward rocking movement to permit the toy to move forward. The rearward wheel prevents rearward tipping of the toy. Note that, although this toy is capable of both forward and rocking movement, it is incapable of vertical reciprocating movement. Furthermore, no means is provided to control the direction of movement of the toy.

U.S. Pat. No. 4,989,856 also discloses a rocking toy which is capable of both forward and rocking movements. The rocking toy is provided with a buffer assembly which includes a wheeled axle that engages selectively the front portions of rocker arms to prevent frontward tipping of the rocking toy during use and to permit forward movement of the toy along the floor. As with the previously described rocker toy, this rocking toy is not capable of vertical reciprocating movement and is not provided with means for controlling the direction of movement of the toy.

U.S. Pat. No. 4,834,402 discloses a wooden rocking horse which is provided with pedals that are manipulated so as to permit rocking movement of the horse, forward movement of the horse, or so as to change slightly the direction of movement of the same. This horse is not capable of vertical reciprocating movement, and the moving direction of the horse cannot be controlled easily and precisely.

SUMMARY OF THE INVENTION

Therefore, the main objective of the present invention is to provide a rocking apparatus which is capable of moving forward, simultaneous vertical reciprocating movement, and in which control of the moving direction of the rocking apparatus can be achieved with ease.

Another objective of the present invention is to provide a rocking apparatus which employs special elliptically-shaped springs to create an up-and-down movement. The bouncing direction of the elliptically-shaped springs can be controlled due to their unique shape, and the elliptically-shaped springs can provide the rocking apparatus with a forward lunging movement to enhance realism when the rocking apparatus is in use.

Still another objective of the present invention is to provide a rocking apparatus which is adapted for use on a floor plate to permit a three-stage play so as to suit the growing needs of a child.

A further objective of the present invention is to provide a rocking apparatus which needs no electricity to prevent it from becoming a financial burden with long-term use.

Yet another objective of the present invention is to provide a rocking apparatus which moves in response to the body movement of the child to enhance user interest, and which can serve to exercise the user at the same time.

Accordingly, the rocking apparatus of the present invention comprises a rocking base and a user support body mounted on the rocking base. The rocking base has a front end with a front strut fixed thereto. The front strut inclines upwardly by a predetermined angle and has a first wheel unit provided thereon. The rocking base further includes two curved rocking plates and a second wheel unit mounted on front ends of the rocking plates. Hard forward rocking movement of the rocking apparatus results in the first and second wheel units contacting a support surface at the same time and the rocking plates separating from the support surface to permit forward movement of the rocking apparatus.

The user support body is hollow and has a vertical cross-section that is generally inverted U-shaped. The user support body includes a horizontal top plate and two side plates that extend along two sides of the top plate. The rocking base has a narrow upper portion that extends into the hollow user support body and a wide lower portion that extends out of the user support body. The rocking base includes a horizontal base plate at the narrow upper portion. The curved rocking plates are disposed at the lower portion. At least one spring unit is interposed between the top plate of the user support body and the base plate of the rocking base to permit vertical reciprocating movement of the user support body. Each of the spring units includes an elliptically-shaped outer shell, and an inner ring is provided in the outer shell. The outer shell has a major axis that lies along a longitudinal length of the user support body and the rocking base. The inner ring has its top and bottom ends connected to the outer shell. The outer shell and the inner ring are made of an elastic material.

The first wheel unit includes a wheel support which is mounted rotatably on a distal end section of the front strut and which is provided with a steering axle that extends therethrough. The wheel support carries a wheel thereat. The rocking apparatus further comprises a pair of reins disposed on two sides of the user support body. Each of the reins has one end tied to the steering axle. The reins are pulled to cause slight turning of the wheel support in order to steer the rocking apparatus.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
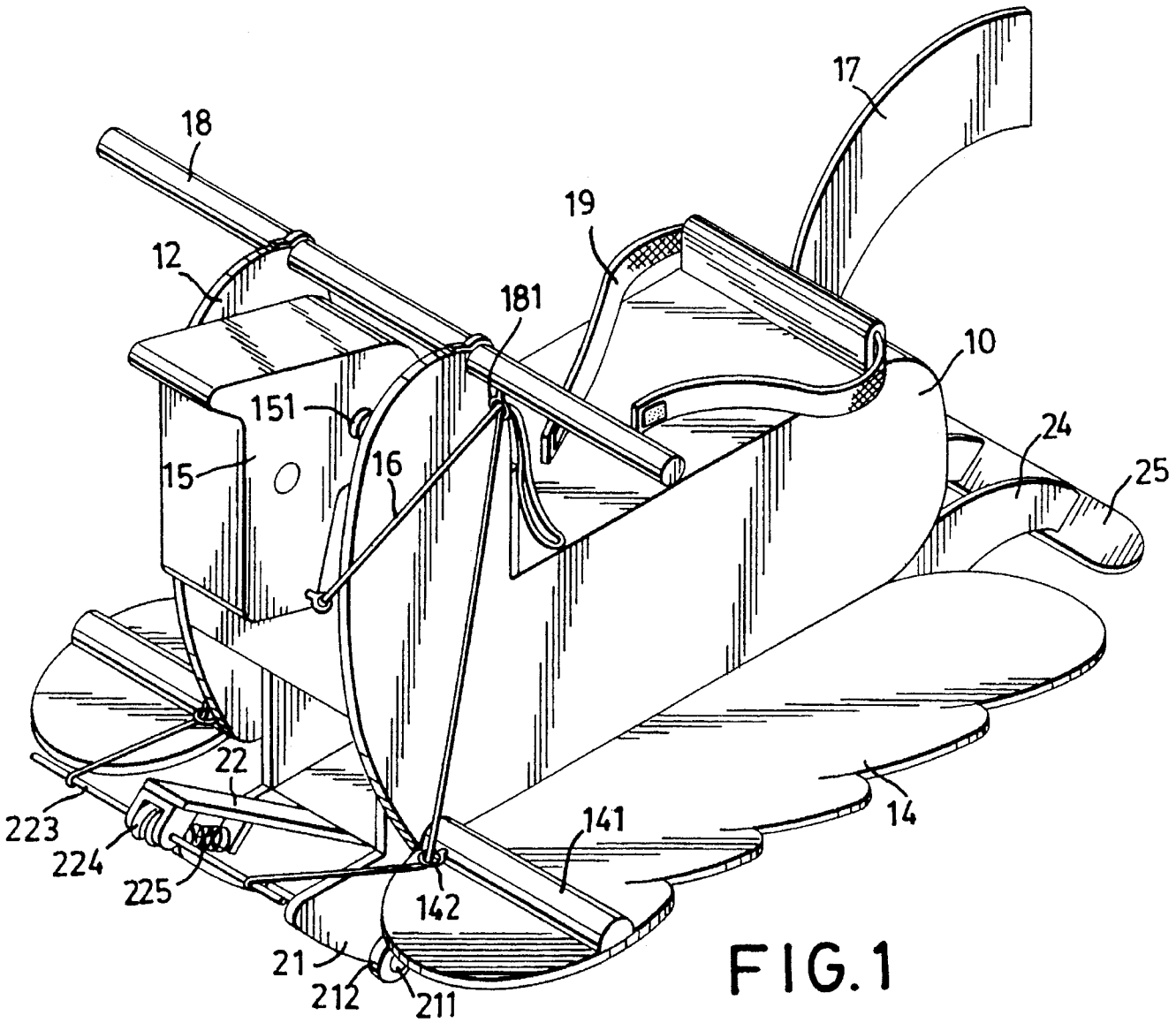
FIG. 1 is a perspective view of the first preferred embodiment of a rocking apparatus according to the present invention.
Figure 2:
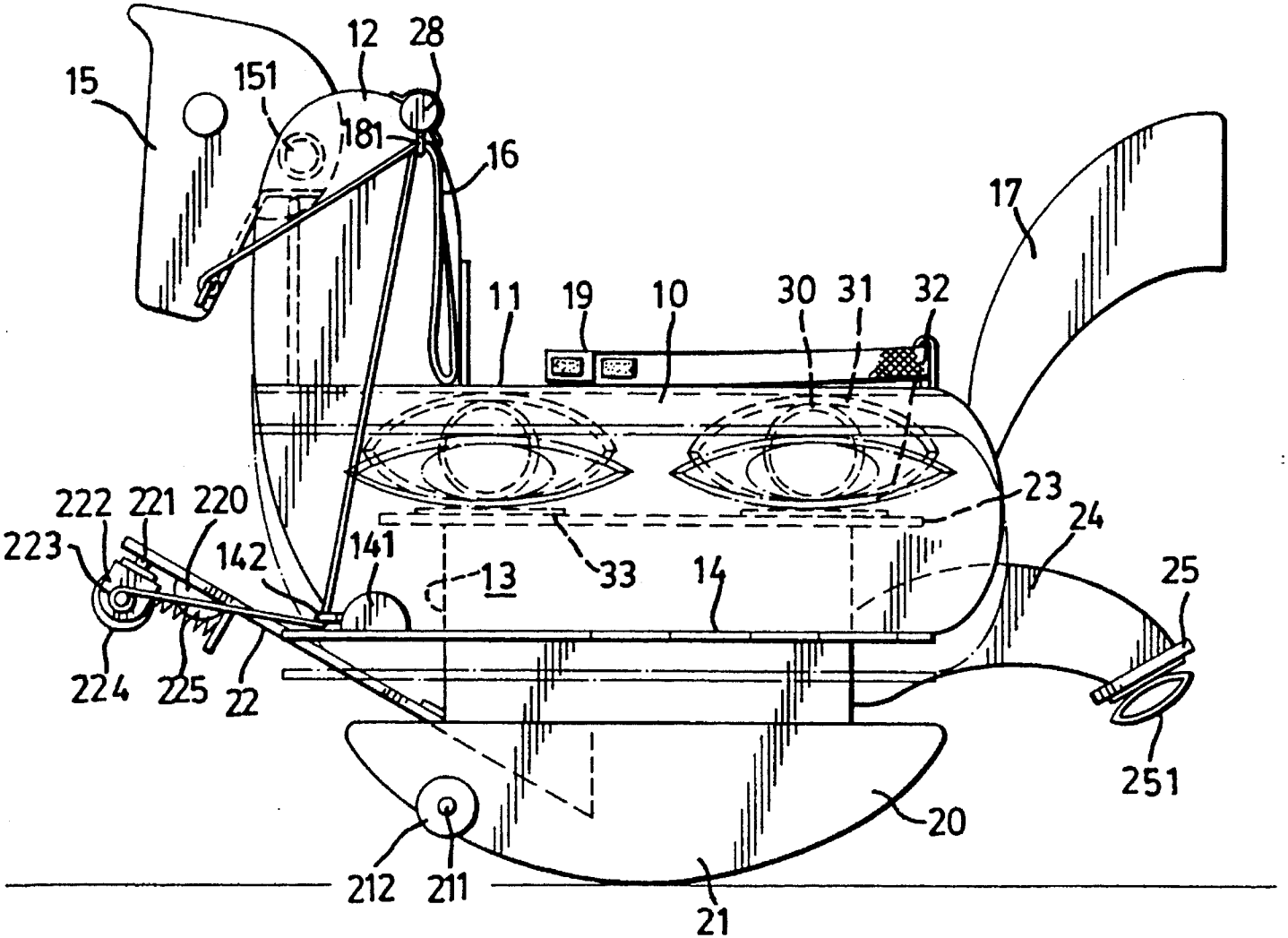
FIG. 2 is a side view of the first preferred embodiment.

Referring to FIGS. 1 and 2, the first preferred embodiment of a rocking apparatus according to the present invention is shown to comprise a user support body 10, a rocking base 20 and spring units 30.

The user support body 10 is hollow and has a vertical cross-section that is generally inverted U-shaped. The user support body 10 includes a horizontal top plate 11, two side plates 13 that extend along two sides of the top plate 11, and two horizontal pedal plates 14 that project respectively from the side plates 13. The pedal plates 14 may be in the form of wings. A transverse foot rest 141 projects upwardly from a front end of each pedal plate 14 and is provided with a ring 142. The user support body 10 further includes two front plates 12 extending from front ends of the side plates 13, and a movable head 15 between the front plates 12. The movable head 15 is in the shape of the head of a horse. Elastic springs 151 connect the two sides of the movable head 15 to the front plates 12 to permit movement of the movable head 15 relative to the front plates 12. A handlebar 18 extends across the front plates 12. Each of the movable head 15 and the handlebar 18 is provided with a pair of rings 152, 181. The user support body 10 further has a curved extension 17 on a rear end for steadying the rocking apparatus, and a seat belt 19 on the rear end of the top plate 11 for securing a child seated on the user support body 10.

The rocking base 20 has a narrow upper portion that extends into the user support body 10, and a wide lower portion that extends out of the user support body 10. Such a design enhances the stability of the rocking apparatus. The rocking base 20 includes a horizontal base plate 23 at the upper portion and two curved rocking plates 21 at two sides of the lower portion. A front strut 22 is fixed to the front end of the rocking base 20 and inclines upwardly by a predetermined angle. A first wheel unit is constituted by a pivot pin 221 on a distal end section of the front strut 22, a wheel support 222 mounted rotatably on the pivot pin 221, a steering axle 223 extending through the wheel support 222, and a wheel 224 carried by the wheel support 222. A positioning plate 220 is mounted on the front strut 22 adjacent to the wheel support 222. A coil spring 225 is provided between the positioning plate 220 and the wheel support 222 and abuts against the wheel support 222 to orient normally the wheel support 222 in a forward direction. A second wheel unit is constituted by an axle 211 that extends through front ends of the rocking plates 21, and a pair of wheels 212 provided respectively on two ends of the axle 211. A curved rear strut 24 extends from the rear end of the rocking base 20 and is provided with a horizontal mounting plate 25. The mounting plate 25 has a bottom surface provided with several oval-shaped elastic damping members 251.

The spring units 30 are interposed between the bottom surface of the top plate 11 of the user support body 10 and the top surface of the base plate 23 of the rocking base 20. Each of the spring units 30 includes an elliptically-shaped outer shell 31 and an inner ring 32 in the outer shell 31. Both of the outer shell 31 and the inner ring 32 are made of quality elastic material, such as thin steel sheets. The top and bottom ends of the inner ring 32 are connected to the outer shell 31. The top and bottom ends of the outer shell 31 are connected to a respective board 33. The boards 33 are fixed respectively to the top plate 11 of the user support body 10 and the base plate 23 of the rocking base 20. In this embodiment, two spring units 30 are interposed between the user support body 10 and the rocking base 20 such that the major axes of the outer shells 31 of the spring units 30 lie along the longitudinal lengths of the user support body 10 and the rocking base 20.

Both sides of the user support body 10 are equipped with reins 16, one end of each rein 16 being threaded through one of the rings 142 and tied to the steering axle 123, the other end of each rein 16 being tied to one of the rings 152 on the movable head 15. The mid-section of each rein 16 extends through one of the rings 181 on the handlebar 18. Slight turning of the movable head 15 and the wheel support 222 results whenever the reins 16 are pulled to steer the rocking apparatus.

Referring again in FIG. 2, when in use, the child is seated on the user support body 10 and secures himself on the same with the use of the seat belt 19. The spring units 30 permit vertical reciprocating movement of the user support body 10 relative to the rocking base 20. Because rocking movement can be combined with vertical reciprocating movement when the rocking apparatus of the present invention is in use, the combined movement makes for a realistic equestrian feeling that takes the child into a new and imaginative space, stirring his or her interest and motivation.

Figure 3:
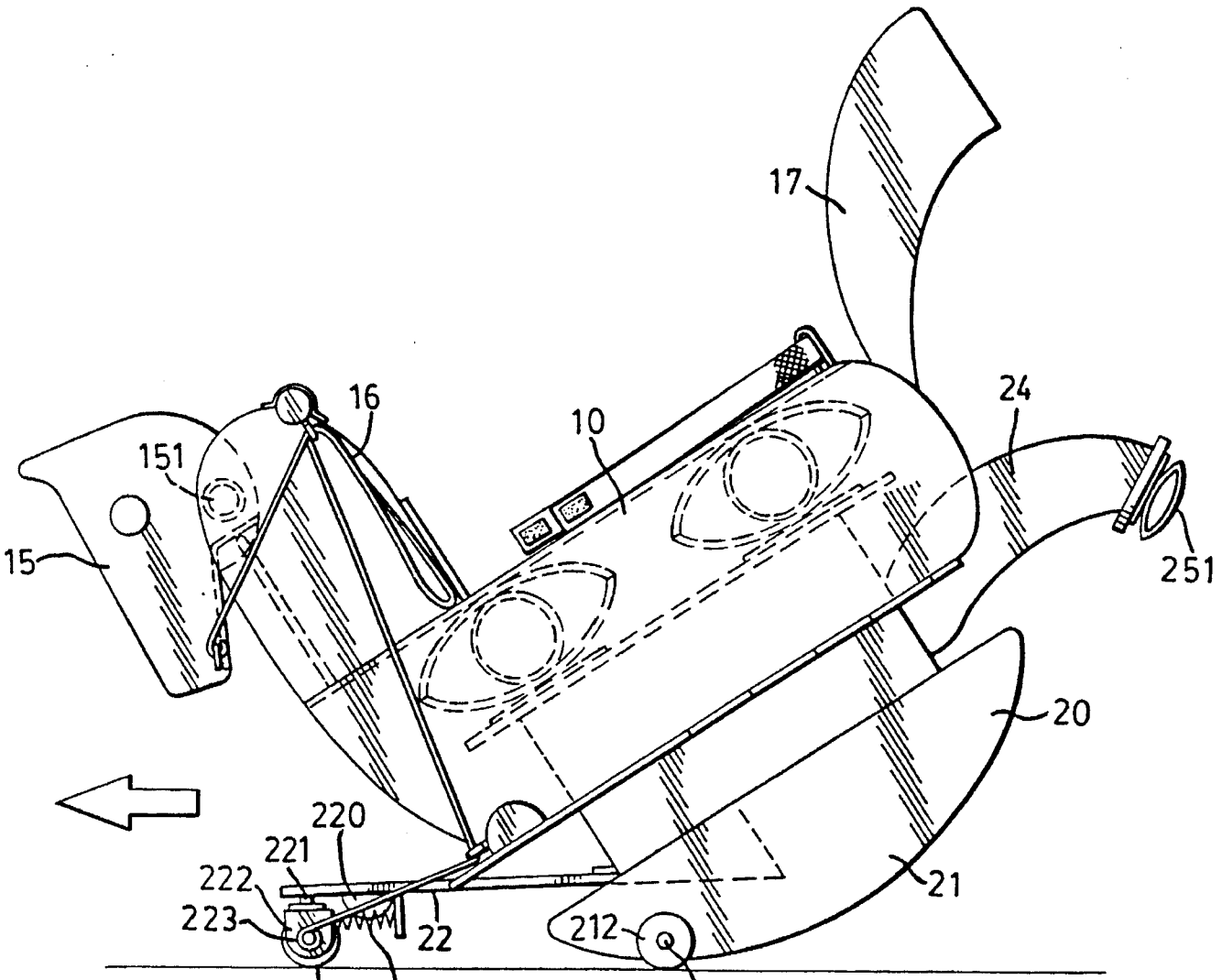
FIG. 3 illustrates how forward movement of the first preferred embodiment is accomplished.

Referring to FIG. 3, when the rocking apparatus rocks forward by a large margin, the wheels 212, 224 contact the support surface at once, while the rocking plates 21 separate from the support surface at the same time. Because of the particular configuration of the spring units 30, the rocking apparatus can move forward by a short distance due to the presence of strong forward impulse.

Figure 4:
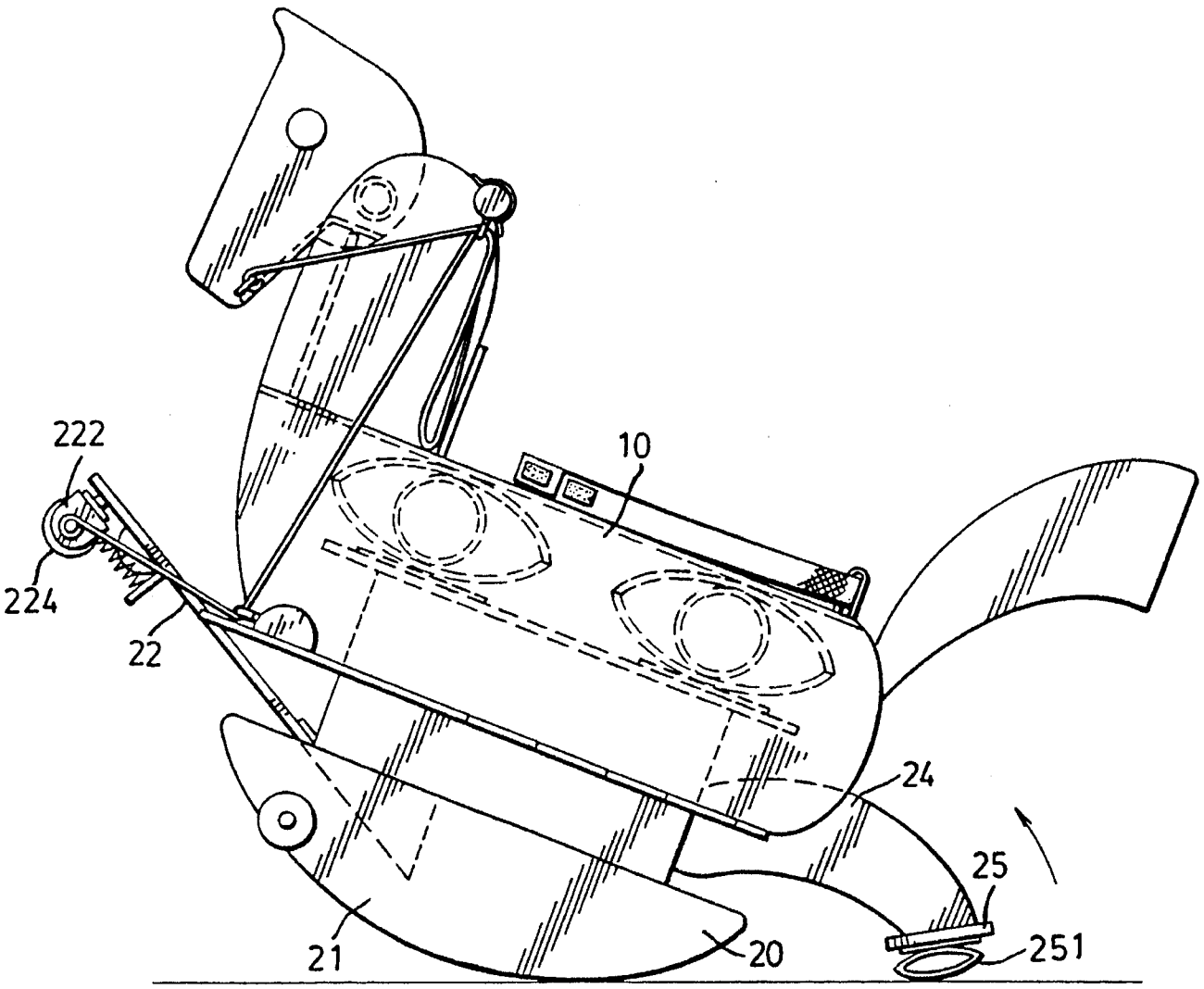
FIG. 4 illustrates how rearward tipping of the toy is prevented.

Referring to FIG. 4, when the rocking apparatus rocks backward, the elastic members 251 on the mounting plate 25 of the rear strut 24 contact the ground, resulting in damping of the movement of the rocking apparatus to help stabilize the same and to prevent rearward tipping. The design of the rocking base 20 of the rocking apparatus, which permits impulse-driven forward movement, adds excitement and novelty, thereby making it suitable for use by older children.

Figure 5:
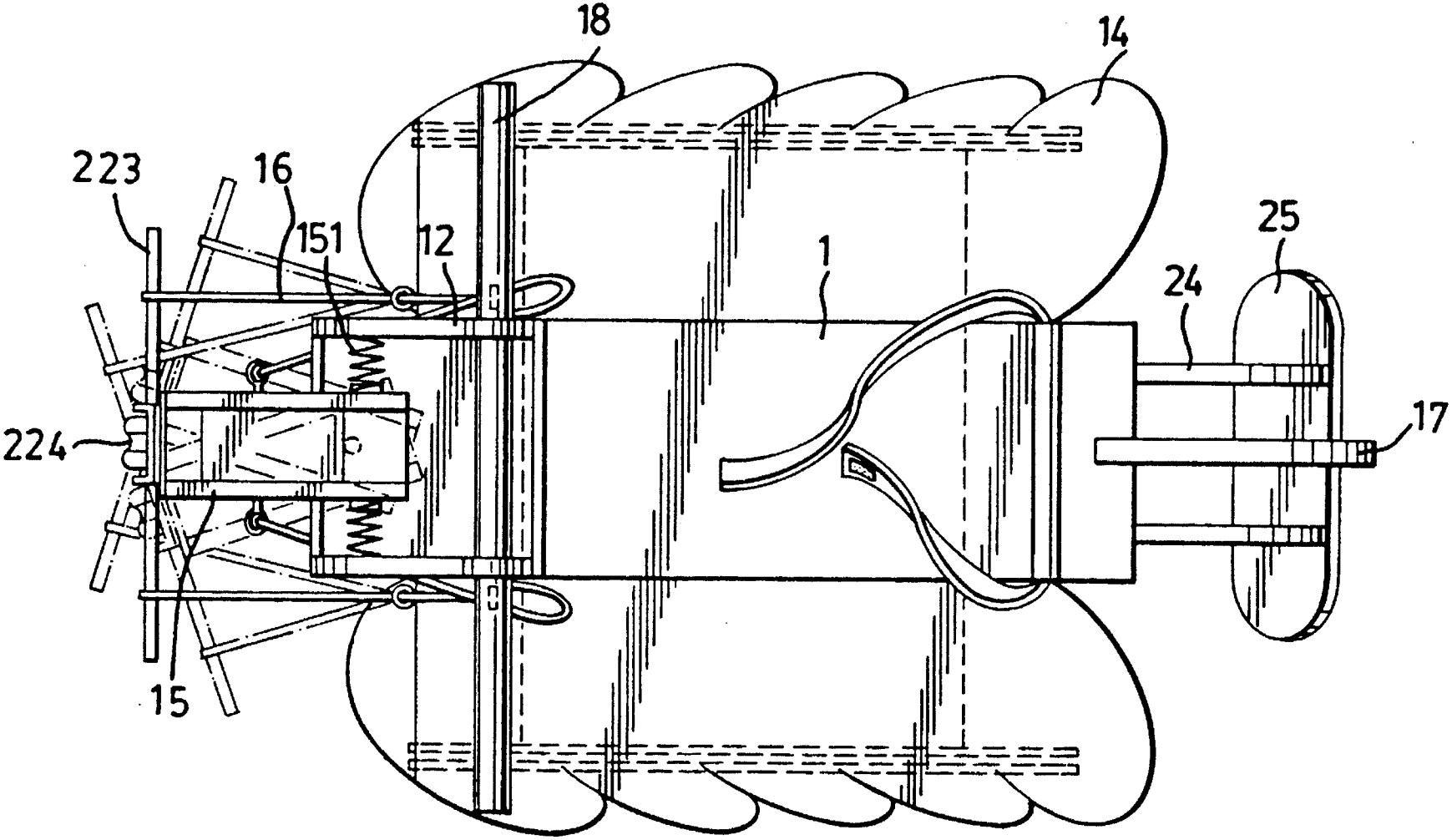
FIG. 5 is a top view showing how the direction of movement of the first preferred embodiment is changed.

In addition, the child may steer the rocking apparatus while the latter is being impelled forward. Referring to FIG. 5, the child grips the handlebar 18 with one hand and pulls one of the reins 16 with the other hand to turn the wheel support 222 and the movable head 15 in the desired direction. The rocking apparatus is steered to enable the child to experience the feeling and excitement of equestrian control.

Figure 6:
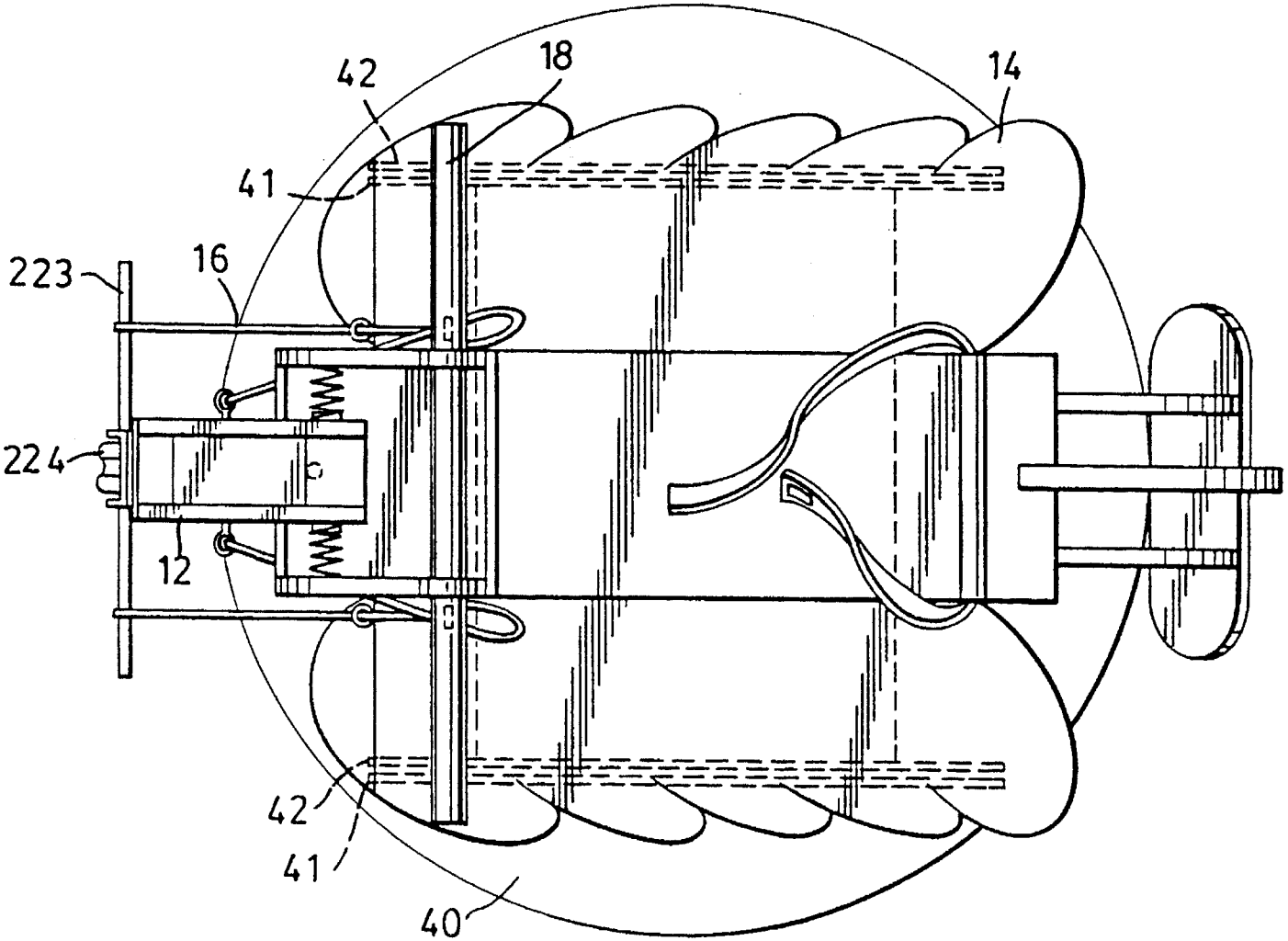
FIG. 6 is a top view of the second preferred embodiment of a rocking apparatus according to the present invention.
Figure 7:
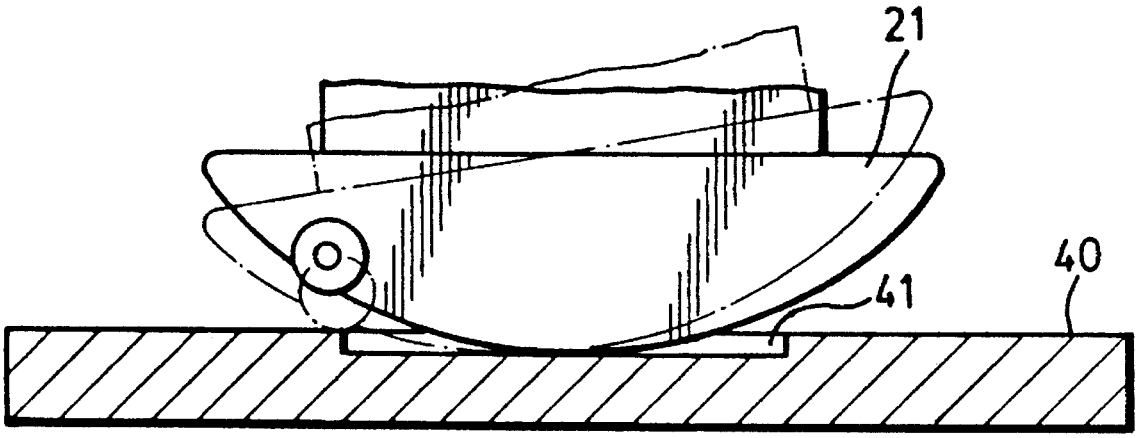
FIG. 7 is a fragmentary side view showing the rocking movement of the second preferred embodiment.
Figure 8:
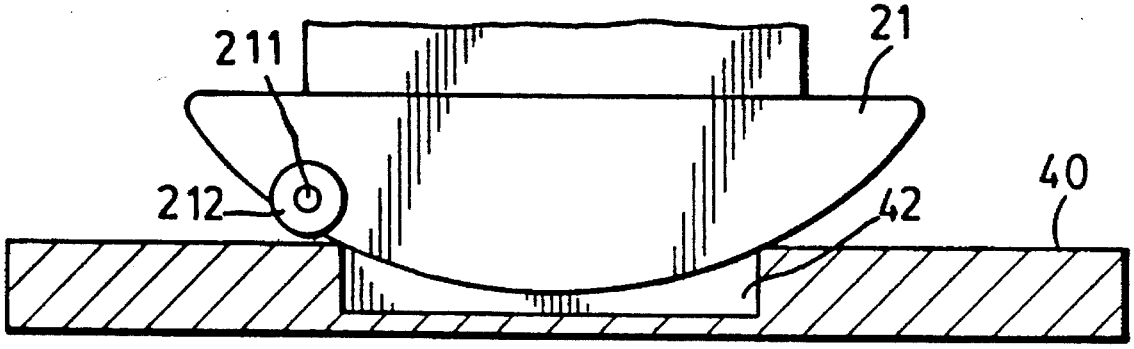
FIG. 8 is a fragmentary side view showing the second preferred embodiment when in a stationary state.

Referring to FIGS. 6, 7 and 8, a floor plate 40 is provided to suit the rocking apparatus of the present invention for use by younger children. The floor plate 40 is formed with a pair of shallow tracks 41 and a pair of deep tracks 42. The rocking plates 21 of the rocking base 20 are extended selectively into the shallow tracks 41 or deep tracks 42.

To limit the rocking movement of the rocking apparatus, the rocking plates 21 are set in the shallow tracks 41, as shown in FIG. 7. The movement of the rocking plates 21 is restricted by the ends of the shallow tracks 41 at this stage. Oval elastic cushions may be placed at the two ends of the shallow tracks 41 to damp the rocking movement of the apparatus.

Referring to FIG. 8, the ability of the rocking apparatus to generate rocking movement is disabled when the rocking plates 21 are set in the deep tracks 42. This is because the rocking plates 21 do not rest on the bottom of the deep tracks 42. Since the weight of the rocking apparatus is applied only to the ends of the deep tracks 42, only up-and-down reciprocating movement of the rocking apparatus is allowed, thereby resulting in a feeling of stability to prevent young children from being easily overwhelmed with fear and insecurity.

The advantages and characterizing features of the rocking apparatus of the present invention are as follows:

1. The spring units 30 permit realistic equestrian up-and-down play. If the rocking plates 21 are set in the deep tracks 42 of the floor plate 40, only up-and-down reciprocating movement is possible due to the presence of the spring units 30. This makes the rocking apparatus ideal for use by infants.
2. When the rocking plates 21 are set in the shallow tracks 41 of the floor plate 40, gentle rocking movement of the rocking apparatus can be combined with vertical reciprocating movement. This makes the rocking apparatus ideal for use by young children.
3. The floor plate 40 is removed when the rocking apparatus is used by older children. Whenever hard forward rocking movement of the rocking apparatus occurs, the wheels 212, 224 contact the floor to permit forward movement of the rocking apparatus due to impulse.
4. The movable head 15 and the wheel support 222 are connected to reins 16 which are operated to turn slightly the former two in order to achieve steering control.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A rocking apparatus comprising a rocking base and a user support body mounted on said rocking base, said rocking base having a front end with a front strut fixed thereto, said front strut inclining upwardly by a predetermined angle and having a first wheel unit provided thereon, said rocking base further having two curved rocking plates and a second wheel unit mounted on front ends of said rocking plates, hard forward rocking movement of said rocking apparatus resulting in said first and second wheel units contacting a support surface at the same time and said rocking plates separating from the support surface to permit forward movement of said rocking apparatus, said user support body being hollow and having a vertical cross-section that is generally inverted U-shaped, said user support body including a horizontal top plate and two side plates that extend along two sides of said top plate, said rocking base having a narrow upper portion that extends into said user support body and a wide lower portion that extends out of said user support body, said rocking base including a horizontal base plate at said upper portion, said rocking plates being disposed at said lower portion, said rocking apparatus further comprising at least one spring unit interposed between said top plate of said user support body and said base plate of said rocking base.

2. The rocking apparatus as claimed in claim 1, wherein each of said spring units includes an elliptically-shaped outer shell and an inner ring provided in said outer shell, said inner ring having top and bottom ends connected to said outer shell, said outer shell and said inner ring being made of an elastic material.

3. The rocking apparatus as claimed in claim 2, wherein each of said spring units further includes two boards fixed respectively to said top plate of said user support body and said base plate of said rocking base, said outer shell having top and bottom ends connected to a respective one of said boards.

4. The rocking apparatus as claimed in claim 2, wherein said outer shell of each of said spring units has a major axis that lies along a longitudinal length of said user support body and said rocking base.

5. The rocking apparatus as claimed in claim 1, wherein said user support body further includes two horizontal pedal plates that project respectively from said side plates.

6. The rocking apparatus as claimed in claim 1, wherein:

said first wheel unit includes a wheel support mounted rotatably on a distal end section of said front strut and provided with a steering axle that extends therethrough, said wheel support carrying a wheel thereat; and said rocking apparatus further comprises a pair of reins disposed on two sides of said user support body, each of said reins having one end tied to said steering axle, said reins being pulled to cause slight turning of said wheel support to steer said rocking apparatus.

7. The rocking apparatus as claimed in claim 6, further comprising a positioning plate mounted on said front strut adjacent to said wheel support and a coil spring provided between said positioning plate and said wheel support, said coil spring abutting against said wheel support to orient normally said wheel support in a forward direction.

8. The rocking apparatus as claimed in claim 1, wherein said user support body further includes two front plates extending from front ends of said side plates, a movable head between said front plates, and elastic springs for connecting two sides of said movable head to said front plates to permit movement of said movable head relative to said front plates.

9. The rocking apparatus as claimed in claim 8, wherein:

said first wheel unit includes a wheel support mounted rotatably on a distal end section of said front strut and provided with a steering axle that extends therethrough, said wheel support carrying a wheel thereat;

said user support body further includes a handlebar that extends across said front plates, and a pair of rings provided respectively on two sides of said movable head and on two ends of said handlebar; and said rocking apparatus further comprises a pair of reins disposed on two sides of said user support body, each of said reins having a first end tied to said steering axle, a second end tied to one of said rings on said movable head, and a mid-section extending through one of said rings on said handlebar, said reins being pulled to cause slight turning of said movable head and said wheel support to steer said rocking apparatus.

10. The rocking apparatus as claimed in claim 9, further comprising a positioning plate mounted on said front strut adjacent to said wheel support and a coil spring provided between said positioning plate and said wheel support, said coil spring abutting against said wheel support to orient normally said wheel support in a forward direction.

11. The rocking apparatus as claimed in claim 1, wherein said top plate of said user support body has a rear end provided with a seat belt.

12. A rocking apparatus comprising a rocking base and a user support body mounted on said rocking base, said rocking base having a front end with a front strut fixed thereto, said front strut inclining upwardly by a predetermined angle and having a first wheel unit provided thereon, said rocking base further having two curved rocking plates and a second wheel unit mounted on front ends of said rocking plates, hard forward rocking movement of said rocking apparatus resulting in said first and second wheel units contacting a support surface at the same time and said rocking plates separating from the support surface to permit forward movement of said rocking apparatus, said rocking base having a rear end with a curved rear strut extending therefrom, said rear strut being provided with a horizontal mounting plate, said mounting plate having a bottom surface provided with a plurality of elastic damping members.

13. The rocking apparatus as claimed in claim 12, wherein said elastic damping members are oval-shaped.

14. The rocking apparatus as claimed in claim 12, wherein:

said first wheel unit includes a wheel support mounted rotatably on a distal end section of said front strut and provided with a steering axle that extends therethrough, said wheel support carrying a wheel thereat; and said rocking apparatus further comprises a pair of reins disposed on two sides of said user support body, each of said reins having one end tied to said steering axle, said reins being pulled to cause slight turning of said wheel support to steer said rocking apparatus.

15. The rocking apparatus as claimed in claim 14, the apparatus further comprising a positioning plate mounted on said front strut adjacent to said wheel support and a coil spring provided between said positioning plate and said wheel support, said coil spring abutting against said wheel support to orient normally said wheel support in a forward direction.

* * * * *